United States Patent [19]

Kunczynski

[11] Patent Number: 4,671,187

[45] Date of Patent: Jun. 9, 1987

[54] DEROPEMENT SENSOR APPARATUS WITH GRAVITY-BIASED, FALLING, MAGNETIC MEMBER

[76] Inventor: Jan K. Kunczynski, 2400 Arrowhead Dr., Carson City, Nev. 89701

[21] Appl. No.: 778,064

[22] Filed: Sep. 20, 1985

[51] Int. Cl.[4] ..... B61B 12/06; H01H 36/00

[52] U.S. Cl. ..... 104/179; 104/173.1; 200/61.18; 242/148; 335/207; 361/180

[58] Field of Search ..... 104/112, 115, 116, 173 R, 104/173 ST, 173.1, 173.2, 178, 179; 200/61.18, 61.13; 340/677, 540, 576, 679; 242/148; 246/249; 335/207; 361/180

[56] References Cited

U.S. PATENT DOCUMENTS

| | | | |
|---|---|---|---|
| 2,685,626 | 8/1954 | Zwack | 200/61.18 X |
| 2,987,593 | 6/1961 | Alley | 335/202 X |
| 3,115,847 | 12/1963 | Turner et al. | 104/178 |
| 3,140,670 | 7/1964 | Renninger | 104/178 |
| 3,302,588 | 2/1967 | Bennett | 104/178 |
| 3,560,846 | 2/1971 | Bessko | 335/207 X |
| 3,611,218 | 10/1971 | Fujita | 335/202 |
| 3,822,369 | 7/1974 | Kunczynski | 200/61.08 |
| 4,019,002 | 4/1977 | Kunczynski | 200/61.18 |
| 4,107,492 | 8/1978 | Moon, Jr. et al. | 335/205 X |
| 4,271,763 | 6/1981 | Berger | 104/179 |
| 4,363,945 | 12/1982 | Kunczynski | 200/61.18 |
| 4,462,314 | 7/1984 | Kunczynski | 104/115 |

FOREIGN PATENT DOCUMENTS

| | | | |
|---|---|---|---|
| 0266541 | 5/1950 | Switzerland | 104/179 |
| 0421169 | 3/1967 | Switzerland | 104/112 |

*Primary Examiner*—Robert B. Reeves
*Assistant Examiner*—Scott H. Werny
*Attorney, Agent, or Firm*—Manfred M. Warren; Robert B. Chickering; Glen R. Grunewald

[57] ABSTRACT

To detect impending deropement of a wire haul rope from supporting sheaves in an aerial tramway system, there is provided a magnetic assembly having sufficient field strength to support itself in a predetermined position by reason of attraction to the wire haul rope when running normally in the sheaves. When the wire haul rope begins to run off one of the sheaves toward an impending deropement, the magnetic assembly will fall from its armed position to a substantially moved position. The magnetic assembly carries at least one position-responsive switch which interrupts a detection circuit when the magnet moves to the moved position. The interruption of the detection circuit is utilized to detect the location of the potential deropement and to terminate tramway operation.

4 Claims, 7 Drawing Figures

DEROPEMENT SENSOR APPARATUS WITH GRAVITY-BIASED, FALLING, MAGNETIC MEMBER

BACKGROUND OF THE INVENTION

Aerial tramways, such as chairlifts, gondolas and the like, are conventionally supported from towers carrying rotating sheave assemblies for guiding and supporting of a wire haul rope to which the chairs, gondolas, etc., are secured. As used herein, the expression "aerial tramway" shall include chairlifts, gondolas, ski lifts, trams and other personnel conveying systems which are based upon a wire haul rope.

Typically, an aerial tramway tower includes a pair of rocker arm assemblies to which the rotatable sheaves are connected for supporting the wire haul rope. A typical rocker arm assembly includes a pair of sheaves mounted near the opposite ends of the rocker arm, with the middle of the arm being pivotally mounted to a support structure. In larger rocker arm assemblies there are four rocker arms on which eight sheaves are rotatably mounted. The four rocker arms are supported from pairs of intermediate rocker arms, and the pair of intermediate rocker arms supported from a common base or support rocker arm. The base or support rocker arm is, in turn, pivotally mounted to a transversely-extending arm from the tower of the aerial tramway. My U.S. Pat. No. 4,462,314 describes such rocker arm assemblies in more detail.

In such aerial tramway systems, it is well known to provide structures to catch the wire haul rope in the event that it runs off a side of one of the sheaves. Such a condition of the haul rope becoming detrained from the sheave is referred to in the art as "deropement". Although it is important to catch the haul rope in the event of a complete or partial deropement, it is even more important to shutdown the rope drive mechanism immediately in the event of deropement and preferably before deropement.

Continued advancement of a deroped haul rope, even if it has been caught by a rope catcher, will advance the passenger carrier units of the tramway dangerously close to the towers. Moreover, if the signal to shut the tramway down is not initiated until after the rope jumps the sheaves, the inertia of the tramway will almost certainly cause at least some of the passenger carrier units to reach the tower at which deropement has occurred, with attendant risk to passengers.

One system for stopping the haul rope drive mechanism in the event of a deropement is shown in my prior U.S. Pat. No. 3,822,369 in which a frangible sensing device is placed proximate a sheave assembly in a position at which a deropement would cause rupture of the frangible sensor.

Another system for detecting a deropement is shown in my U.S. Pat. No. 4,019,002. According to that patent, movable, low inertia portions of the sheave assembly are biased by a spring loaded mechanism assembly for movement in the event of deropement of the haul rope. Although the apparatus of my U.S. Pat. No. 4,019,002 had advantages over the prior art, one disadvantage was its susceptibility to being rendered inoperative because of ice or snow.

Also in the prior art, my U.S. Pat. No. 4,363,945 taught an electrical circuit having a plug-end connector which was mechanically pulled apart from the remainder of the circuit upon deropement of the haul rope.

Upon the plug-end connector being pulled apart, the drive system for the haul rope was interrupted or deactivited.

As still another example of the prior art, my U.S. Pat. No. 4,462,314 taught a haul rope deropement detector including a frangible element mounted at a position proximate both the leading and trailing sheaves of a rocker arm assembly. More particularly, the frangible element was placed in a position whereby it would be broken upon deropement of the haul rope onto a rope catcher, and the system operated analogously to a fuse in an electrical circuit to cause interruption of electrical power in the event of a deropement.

All such prior art systems are based upon the haul rope leaving or jumping from the sheave assembly. They are, in effect, after-the-fact shut down systems which require deropement to operate. It is highly desirable, however, to detect an impending deropement and to be able to stop the tramway prior to the rope leaving the sheaves.

One approach to this goal which has been employed in the industry is to provide a proximity switch next to the haul rope. Such proximity switches have taken the form of a reed switch which is normally closed as a result of being attracted to the haul rope. The reed switch is mounted in close proximity to the haul rope as it is supported for axial movement along a normal or nominal path over the sheaves. If the haul rope should be laterally displaced relative to the reed switch, for example by walking or creeping of the haul rope up the side of a sheave prior to deropement, the proximity reed switch will open, shutting down the tramway prior to deropement or at least soon after deropement.

The problem with such prior art reed switch deropement detectors has been that the aerial tramways regularly are subjected to considerable static electrical charges. Such changes can affect the reliability of the opening of the reed switch. Additionally, lightning strikes also are quite common at tramway installations, and the reed proximity switch tends to become contact welded in a closed condition. Thus, when the haul rope deropes from the sheaves, the welded closed reed switch will not open, and the tramway continues to operate. As a result of such problems, the reed-based proximity switch has been banned from use in tramway systems in many European countries.

OBJECTS OF THE INVENTION

It is an object of the present invention to provide a system, including a sensor and novel method, for detecting impending deropement of a wire haul rope from a support sheave in an aerial tramway system.

Another object of the present invention is to provide a haul rope deropement detection apparatus and method which has improved reliability to enhance the safety of tramway operation.

Still another object of the present invention is to provide a system, including a sensor and novel method, for detecting impending deropement of a wire haul rope in an aerial tramway system where the detection system is not activated by ordinary vibrations or other movement of the wire haul rope.

Still a further object of the present invention is to provide an essentially fail-safe sensor and method for detecting impending deropement of a wire haul rope in an aerial tramway system where the detection system is operative under extreme conditions and accumulations of ice or snow.

Another object of the present invention is to provide a haul rope deropement sensor apparatus and method that will prevent tramway operation in the event of a lightning strike at the sensing apparatus.

Yet another object of the present invention is to provide a sensor and method for detecting both impending and actual deropement of a wire haul rope from a sheave utilized to train the haul rope in an aerial tramway system.

The deropement sensor apparatus and method of the present invention has other objects and features of advantage, some of which will be set forth in more detail or will become apparent from the description hereinafter and the accompanying drawing.

SUMMARY OF THE INVENTION

In accordance with the preceding objects, the present invention provides a system including a sensor for detecting impending deropement of a wire haul rope from a sheave or the like utilized to support the rope in an aerial tramway system. The deropement sensor apparatus comprises, briefly, mounting means formed for mounting of the apparatus proximate a side of the haul rope, magnet means mounted to the mounting means for movement between an armed position and a moved position, means biasing the magnet means toward the moved position, and switch means formed for switching upon movement of the magnet means to the moved position. The mounting means preferably includes a housing having a non-magnetically susceptible wall which is located to position the magnet means in the armed position at a distance from the haul rope sufficiently close to the haul rope so that the magnetic field of the magnet attracts the magnet to the ferromagnetic haul rope with a force greater than the biasing force. The means biasing the magnet toward the moved position preferably is the mounting means which is formed for gravity biasing of the magnet means toward the moved position. The distance between the haul rope and magnet in the armed position also is sufficient so that movement of the haul rope laterally of its normal path by a predetermined distance increases the gap with respect to the magnet and decreases the magnetic attraction force to a level below the gravity biasing force, causing the magnet to move under the influence of gravity to the moved position.

The detection system most preferably includes a housing mounted stationarily on a rocker arm intermediate a pair of sheaves rotatably supported by the rocker arm. Further, the detection system preferably includes at least on position-responsive switch mounted to the magnet means to convey a detection current when the magnet means is positioned against a top wall of the housing and to interrupt the detection current when the magnet means falls to a substantially skewed orientation relative to the top wall as indicative of impending deropement.

Further in accordance with the preceding objects, the present invention provides an improved method for detecting impending deropement of a wire haul rope from sheave means. According to the method of the invention, a magnet means is provided having magnetic field strength which is sufficient to hold the magnet means in an armed position against the bottom face of a non-magnetically susceptible member which is stationarily positioned a predetermined distance beside the normal path of travel of the wire haul rope. The magnetic field strength provided by the magnet means, however, is not sufficient to hold the magnet means in position against a biasing force such as gravity when the wire haul rope moves substantially toward impending deropement. Further, according to the method of the present invention, detection means is provided and operable when the magnet means moves away from the armed position to a substantially skewed position thereby indicating impendin deropement.

In accordance with the preceding, the objects and advantages of the present invention will no doubt become obvious to those of ordinary skill in the art after having read the following detailed description of the preferred embodiment which is illustrated in the various drawing figures.

DESCRIPTION OF THE PREFERRED EMBODIMENT

Figure 1:
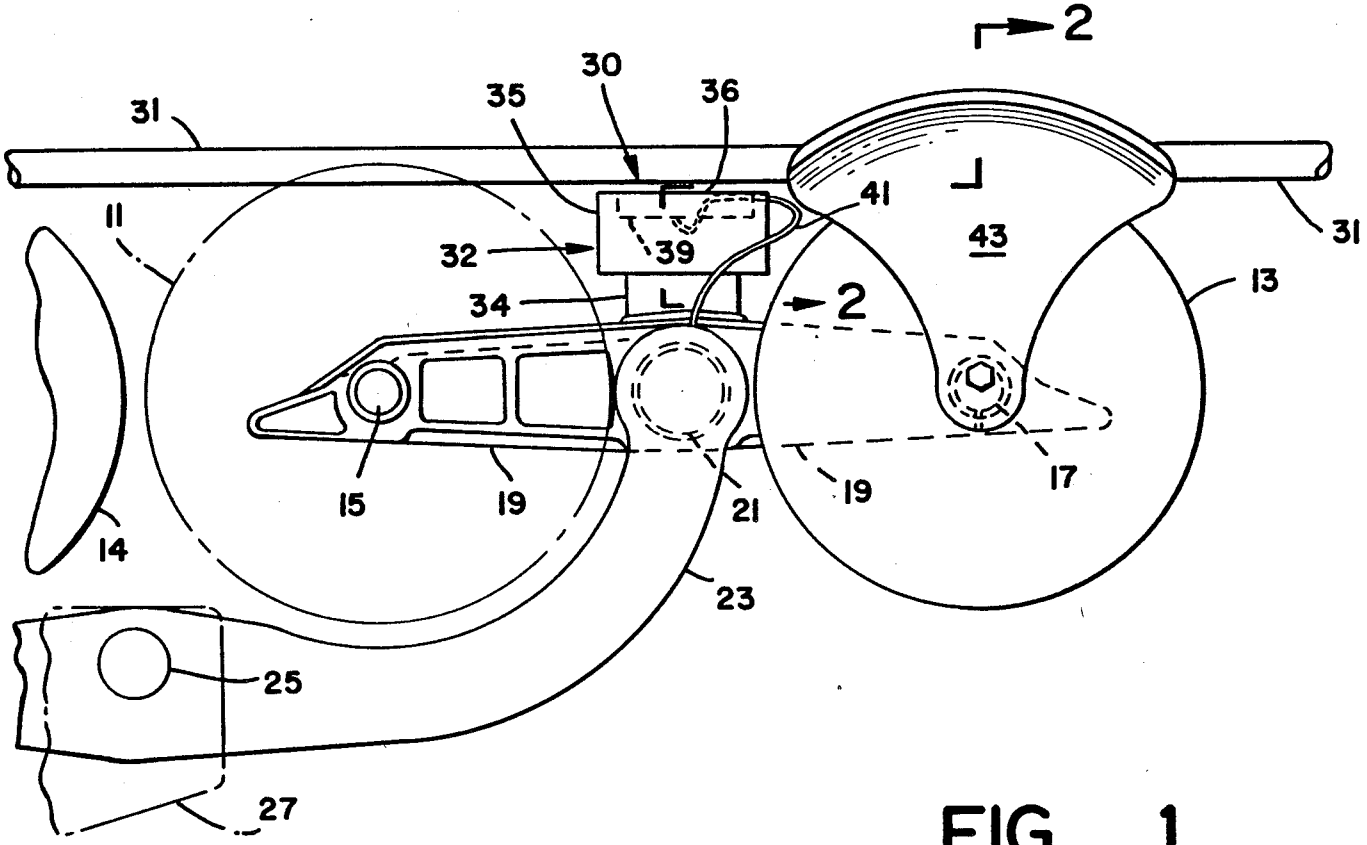
FIG. 1 is a side elevation view of a rocker arm assembly for an aerial tramway including components of a system according to the present invention.

The rocker assembly as shown in FIG. 1 of the drawings generally includes a first pair of spaced-apart sheaves 11 and 13 rotatably mounted by axles 15 and 17, respectively, which sheaves are carried by a first rocker arm 19. First rocker arm 19 is an elongate member which can have various structural configurations so long as it rigidly supports the sheaves 11 and 13 for free rotation. In the illustrated embodiment, first rocker arm 19 is pivotably supported at its midpoint by a shaft 21 mounted to a second rocker arm 23, only partially shown in the drawing. Second rocker arm 23, in turn, is supported at its midpoint by a pivot shaft 25. It should be appreciated that a second pair of sheaves, including sheave 14, is carried by second rocker arm 23 opposite the pair of sheaves 11 and 13 so that rocker arm 23 is generally balanced about pivot shaft 25. In practice, rocker arm 23 is supported from a structure 27 which can be another rocker arm or the transverse arm of a tramway tower or the like.

As also shown in FIG. 1, a conventional wire haul rope 31 is trained over the sheaves 11, 13 and 14. Typically, the wire rope is a cable comprised of a plurality of twisted or otherwise intertwined strands. The configuration and construction of the wire haul rope 31 is not critical to the present invention so long as the wire haul rope 31 includes a substantial number of strands of ferromagnetic or a magnetic field responsive material.

Figure 2:
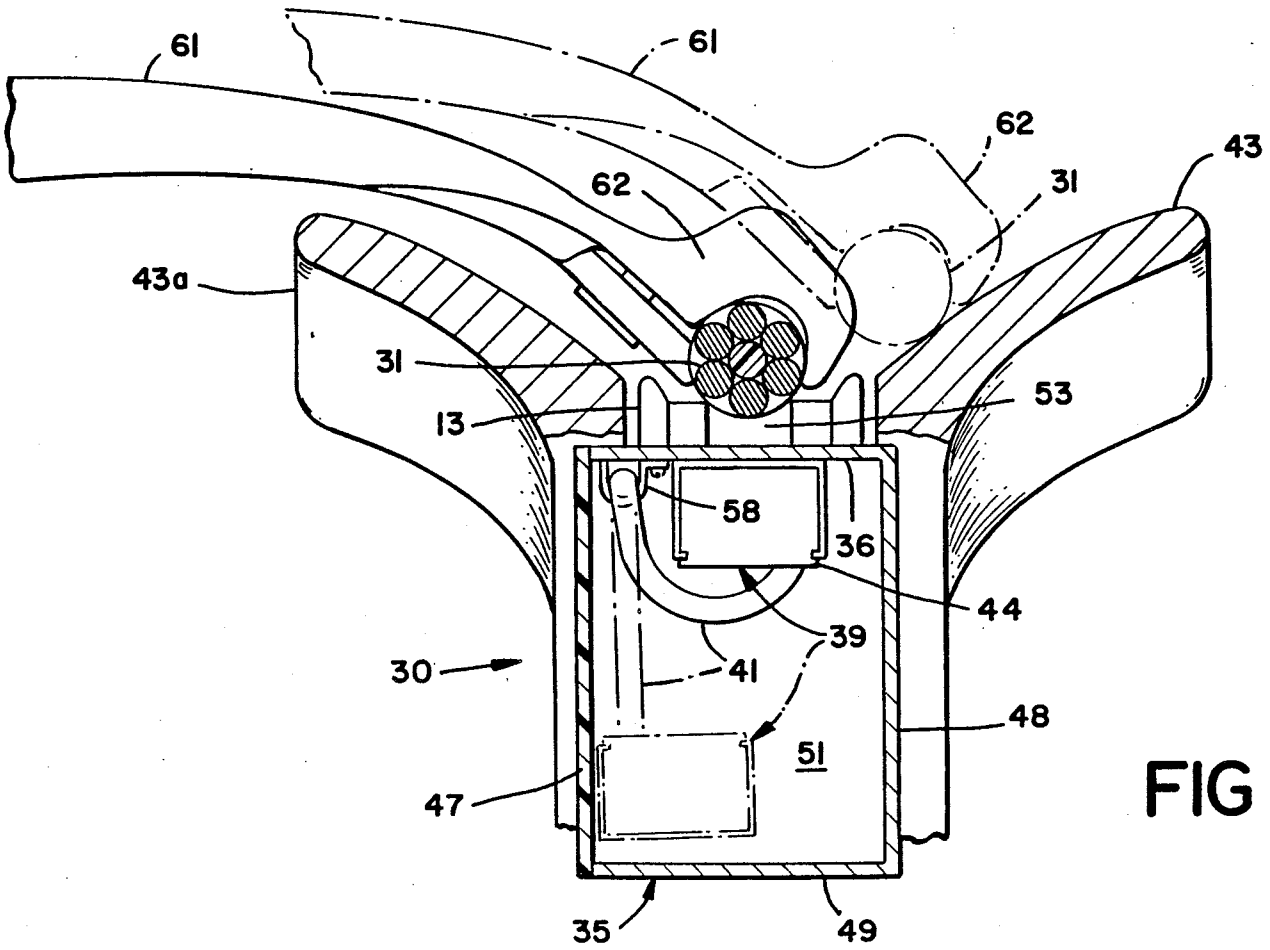
FIG. 2 is an enlarged end elevation view, partially in cross section, taken substantially along the planes defined by the line 2—2 in FIG. 1 for viewing in the direction of the arrows

Conventionally, tramway haul ropes are formed with six high strength steel strands twisted about a central packing or non-metallic core, as best may be seen in FIG. 2.

The sensor apparatus of the present invention, generally designated 30, is formed with mounting means, generally designated 32, which preferably includes a mounting base 34 and a sensor housing 35. Mounting base 34 may be secured to rocker arm 19 by fasteners, or adhesives or by welding, but it will be understood that base 34 can be formed for mounting to other structures, as long as mounting means 32 positions sensor 30 in a substantially fixed, spaced relationship to the normal or nominal path of advancement of the haul rope proximate a side of haul rope 31.

Mounted for movement with respect to mounting means 32, and particularly housing 35, is magnet means 39. As shown in FIGS. 1 and 2 in solid lines, magnet means 39 is positioned inside housing 35 which shields the magnet means and associated switches from ice and snow. The magnetic field of the magnet pulls or attracts the magnet toward ferromagnetic haul rope 31, and the magnet is supported in an "armed position" at a spaced distance from rope 31 by housing top wall 36. The rope is also attracted toward the magnet, but the high axial tension in the rope prevents any significant displacement of the rope toward the magnet. The magnet also is mounted to mounting means 32, i.e., housing 35, for movement to a "moved position," as shown in FIG. 2 in phantom. Moreover, the apparatus of the present invention includes means biasing magnet means 39 away from the armed position and toward the moved position.

In the preferred form of the invention biasing is achieved by mounting means 32, namely, mounting means 32 is oriented to position magnet means 39 beneath rope 31 so as to gravity bias the magnet away from wall 36 and toward the phantom line position shown in FIG. 2. As will be understood, however, the apparatus of the present invention also could be spring biased away from the armed position and toward the moved position.

Regardless of the biasing technique, mounting means 32 is formed to position magnet means 39 at a distance sufficiently close to haul rope 31 so that the magnetic attraction force between the magnet and the rope is greater than the biasing force toward the moved position. Thus, the attraction force holds the magnet up against wall 36 as long as the haul rope is supported in its normal position on sheaves 11 and 13. It should be noted that sheaves 11 and 13 and rocker arms 19 and 23 are typically non-ferromagnetic assemblies, being formed principally of aluminum with rubber and plastic components. Magnet means 39 will not, therefore, be attracted to the sheave assembly to any significant degree. In sheave assemblies containing significant ferreomagnetic components, the magnet means must be positioned or mounted remote of such components or mounted in a position in which the influence of such components merely adds to the force biasing the magnet means to the moved position.

The strength of the magnetic field generated by magnet means 39 and the weight of the magnet means (when gravity biased) will determine the gap or distance between haul rope 31 and magnet means 39 which will cause the magnet means to remain attracted up against wall 36 in the armed position. Additionally, the attraction force should be greater than the biasing force by an amount such that normal vibrations will not cause the magnet to be vibrated away from wall 36 during acceleration of the mass of magnet 39 during vibration.

The distance at which support wall 36 is positioned from the side of rope 31 also should be selected so that lateral movement of rope 31 a known distance from its normal path on the sheave assembly will increase the gap between the magnet and rope sufficiently that the attraction force will be less than the biasing force. When this occurs, the magnet will fall from the armed to the moved position. Preferably the predetermined distance of displacement which will cause movement of magnet means 39 will be less than the lateral displacement required to derope the haul rope from the support sheave and any rope deflection structure, such as deflectors 43 and 43*a*.

Determination of the distance at which wall 36 should support magnet means 39 from rope 31 can be made easily imperically. Although not illustrated in the drawings, base 34 can be formed for adjustment of the distance between the rope and wall 36. Rope 31 can be positioned or displaced on a test bench near the edge of the sheaves and deflection structure, The gap between wall 36 and rope 31 then can be increased until the magnet falls away from wall 36. For about a one inch diameter steel haul rope and a two pound permanent horseshoe type magnet, an air gap of about $\frac{1}{2}$ to $\frac{3}{4}$ of an inch will support the magnet against wall 36 with an attractive force which is two to three pounds greater than the gravity biasing force. This will hold magnet assembly 39 against wall 36 during normal operation and will release the magnet in the event of excessive vibration or lateral displacement of the haul rope to the edge of the sheaves and rope deflection structure.

It is an important feature of the detection apparatus and method of the present invention that in addition to detecting impending deropement it functions to detect abnormal vibration at the rope support assembly, such as the sheave rocker arm.

Figure 5:
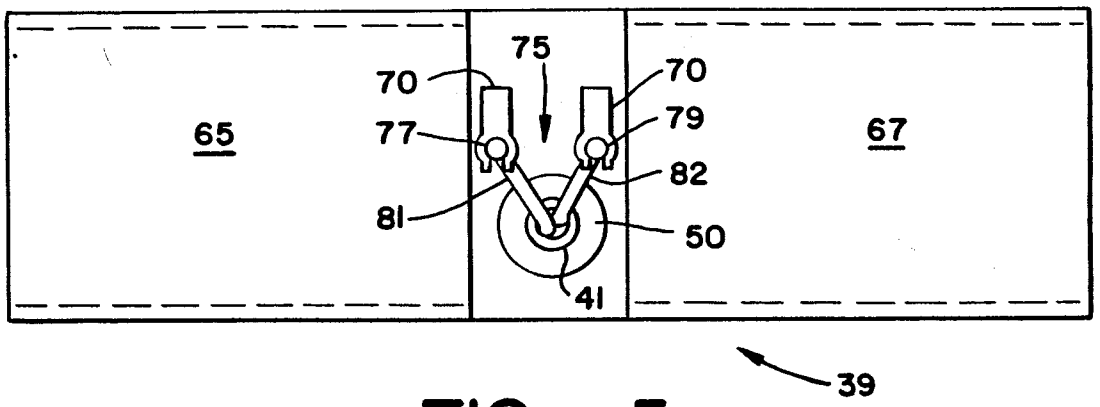
FIG. 5 is a top plan view of the components shown in FIG. 4 with the cover removed.
Figure 4:
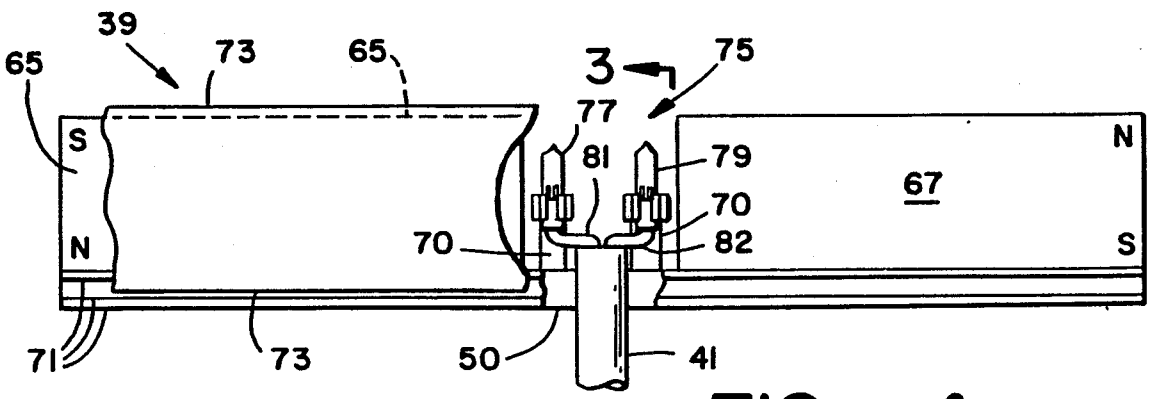
FIG. 4 is a side view of the components shown in FIG. 3 and with the cover member broken away for purposes of illustration.
Figure 3:
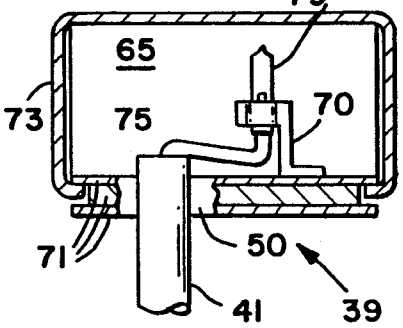
FIG. 3 is a further enlarged end elevation view, partially in cross section taken substantially along the plane of line 3—3 in FIG. 4.

The sensor apparatus of the present invention further includes switch means 75, best seen in FIGS. 3–5, formed for switching to a changed state upon movement of magnet means 39 to the moved position. In the most preferred form switch means 75 is provided as a mercury switch carried by magnet means 39. Switch 75 may be normally closed in the armed position and then will change state, or open, when the magnet falls to the moved position.

As will be appreciated, switch means 75 may take other forms and need not be carried by magnet means 39. A limit switch which is mounted to a housing wall and contacted by the falling magnet would, for example, be suitable for use in the present detector.

Housing 35 has a generally box-like configuration comprising spaced-apart side walls 47 and 48, the top wall member 36, and a bottom wall 49. Housing 35 further includes end walls, only one of which is shown in FIG. 2 and indicated by the number 51. In practice, side wall 47 is formed of a transparent material so that the interior of housing 35 can be readily viewed.

FIG. 2 further shows magnetic means 39 mounted in its armed position within housing 35 flush against the bottom face of top wall member 36. The normal or nominal position of wire haul rope 31 can be understood from the drawing to be the position whereat the wire haul rope runs within a medial groove 53 in sheave 13 and within aligned medial grooves (not shown) in sheave 11, 14 and the remaining sheaves in the assembly. FIG. 1 also shows that the distance from top wall 36 to wire haul rope 31 is normally substantially constant when housing 35 is mounted intermediate sheaves 11 and 13

FIG. 2 shows, in phantom lines, the position of wire haul rope 31 after it has run out of medial groove 53 onto the top surface of rope deflector member or ear 43. When wire haul rope 31 is in the position shown by the phantom lines, the distance between the centerline of the rop and magnet assembly 39 has substantially increased and, therefore, the magnetic force of attraction holding magnet assembly 39 against the face of top wall 36 has substantially decreased.

FIG. 2 also shows a flexible conduit 41 having electrical conductors mounted therein and having an intermediate portion attached to housing 35, as by a bracket 58, as well as to magnet assembly 39 by a grommet or potting 50. A function of the conductor conduit 41 is to support the magnet assembly 39 when the assembly falls away from top wall 36. Thus, in phantom lines, FIG. 2 shows the position of the magnet assembly 39 after it has fallen from the top wall 36 and is supported by the electrical conductor conduit 41. It is preferable that conduit 41 be coupled to magnet assembly 39 pro imate far side 44 of the assembly so as to enhance the rotating action as the assembly falls to the moved position. Conduit 41 also extends outside housing 35 and passes through an opening in rocker arm 23 and through the rocker arm assembly to the tramway tower for electrical connection of the sensor to a detection and control circuit at the tramway drive terminal.

FIG. 2 also shows an arm 61 clamped to wire haul rope 31. Arm 61 is provided to support the passenger carrier unit carried by the aerial tramway from haul rope 31. In practice, the carrier unit may be a chair for one or more persons, a gondola, or a large tram.

As shown in FIGS. 3–5, magnet assembly 39 includes a pair of spaced-apart permanent bar magnets 65 and 67 mounted to a ferromagnetic support member 71. In the illustrated embodiment, the bar magnet 65 is mounted so that its north pole is facing support member 71, and bar magnet 67 is mounted with its south pole facing support member 71. The support member 71 is formed of one or more laminated pieces of ferromagnetic material, so that the magnetic lines of force between the north pole of bar magnet 65 and the south pole of bar magnet 67 run lengthwise through the support member. The resulting structure produces a magnetic flux pattern which is projected laterally and then extends, generally parallel to rope 31 and is essentially like the well-known horseshoe magnet.

As will be apparent magnet means 39 also may be provided as an electromagnet, but a permanent magnet assembly is 5 preferred.

FIGS. 1 and 3 show the bar magnets 65 and 66 enwrapped by a casing 73 that also clamps the magnets to the support member 71. It should be understood, however, that other means can readily be provided to attach the magnets to the 0 support member 71 and, accordingly, that the casing 73 is optional. When the casing 73 is utilized, however, it should be formed of a non-magnetically susceptible material. In the absence of the casing 73, the magnet members 65 and 67 may be painted to protect them against weathering corrosion.

FIGS. 3–5 further show a position-responsive switch, generally designated by the number 75, fixedly connected to the support member 71 between bar magnets 65 and 67. Preferably, the position-responsive switch includes at least one pair of mercury switches 77 and 79 mounted by brackets 70 to support member 71. Each mercury switch includes two spaced-apart contact terminals mounted within a tubular enclosure containing a quantity of mercury such that, in one position of the tubular enclosure, electrical communication is provided between the spaced-apart contact terminals by the mercury, but when the tubular container is in an orientation substantially skewed from the first position, the mercury flows to a position in the enclosure at which it does not provide electrical communication between the contact terminals. Such mercury position-responsive switches are well known and commercially available. The position of the magnet assembly shown in FIGS. 3 and 5 is the upright orientation and it should be understood that, in such an orientation, the mercury within the position-responsive switches 77 and 79 accomplishes electrical conduction between the two terminals of each of the switches.

As best shown in FIGS. 4 and 5, the electrical conductor conduit 41 carries a first pair of wires in sub-conduit 81 connected to the position-responsive switch 77 and a second pair of wires in sub-conduit 82 connected to the position-responsive switch 79. It should be understood that, for wire pair in sub-conduit 81, one wire is connected to one of the contact terminals of switch 77 and the other wire is connnected to a second contact terminal of switch 77. Likewise, the two wires of the pair in sub-conduit 82 are connected, respectively, to the two contact terminals of position-responsive switch 79.

Switches 77 and 79 are preferably connected to each other in series through the wires in sub-conduits 81 and 82, although parallel connection is possible with appropriate support circuitry. The advantage of having the two mercury switches 77 and 79 carried by magnet assembly 39 connected in series is that opening of either switch will shut down haul rope operation.

As will be understood, multiple sensors also can be positioned over the length of the haul rope. Both series connection of the sensor assemblies and parallel connection are contemplated. In the preferred form, however, the sensors are electrically connected in series so that the opening of a switch at any location along the haul rope will shut down or interrupt the power to drive the haul rope.

The function and operation of the embodiment of FIGS. 1–5 can now be readily understood. In the normal condition, magnet assembly 39 will hold itself flush against the top wall 36 of the housing 35 by means of magnetic attraction to the ferromagnetic wire haul rope trained in the groove 53 of the sheave 13. In such a position, the position-responsive switches 75 will be upright as shown in FIGS. 3–5, and electrical current will flow through switches 77 and 79 and an associated electrical circuit well known in the art.

Under conditions of an impending deropement of the wire haul rope from either of sheaves 11 and 13, wire haul rope 31 will migrate or be displaced laterally away from its centered position on the medial grooves in the sheaves. Under such conditions, the force of magnetic attraction of the magnetic assembly 39 toward the wire haul rope will weaken and, with further migration of the wire haul rope 31, the magnetic force will no longer be capable of supporting the magnetic assembly 39 against the gravity biasing force. As a result, magnetic assembly 39 will fall to the moved position as shown by the phantom lines in FIG. 2. With magnetic assembly 39 in the moved position, the liquid mercury in switches 77 and 79 will flow to a position in the enclosures such that current is interrupted between the contact terminals within switches 77 and 79. Such interruption of current will interrupt power to the haul rope drive (not shown) thereby causing wire haul rope 31 to stop running. After stoppage of wire haul rope 31, the cause of the potential deropement can be investigated and appropriate remedial action taken. It is well known in the art to provide an electric circuit which will indicate at which tower a switch has opened. Typically, on-sight investigation would include a visual inspection of the sheaves at which the potential deropement occurred.

To reactivate the rope drive, wire haul rope 31 is positioned aga1n in the medial grooves of the sheaves, and the magnet1c means 39 is repositioned in the armed position against the face of top wall 36; this position again will be held by the attraction of the magnetic means to the adjacent wire haul rope.

Figures 6, 7:
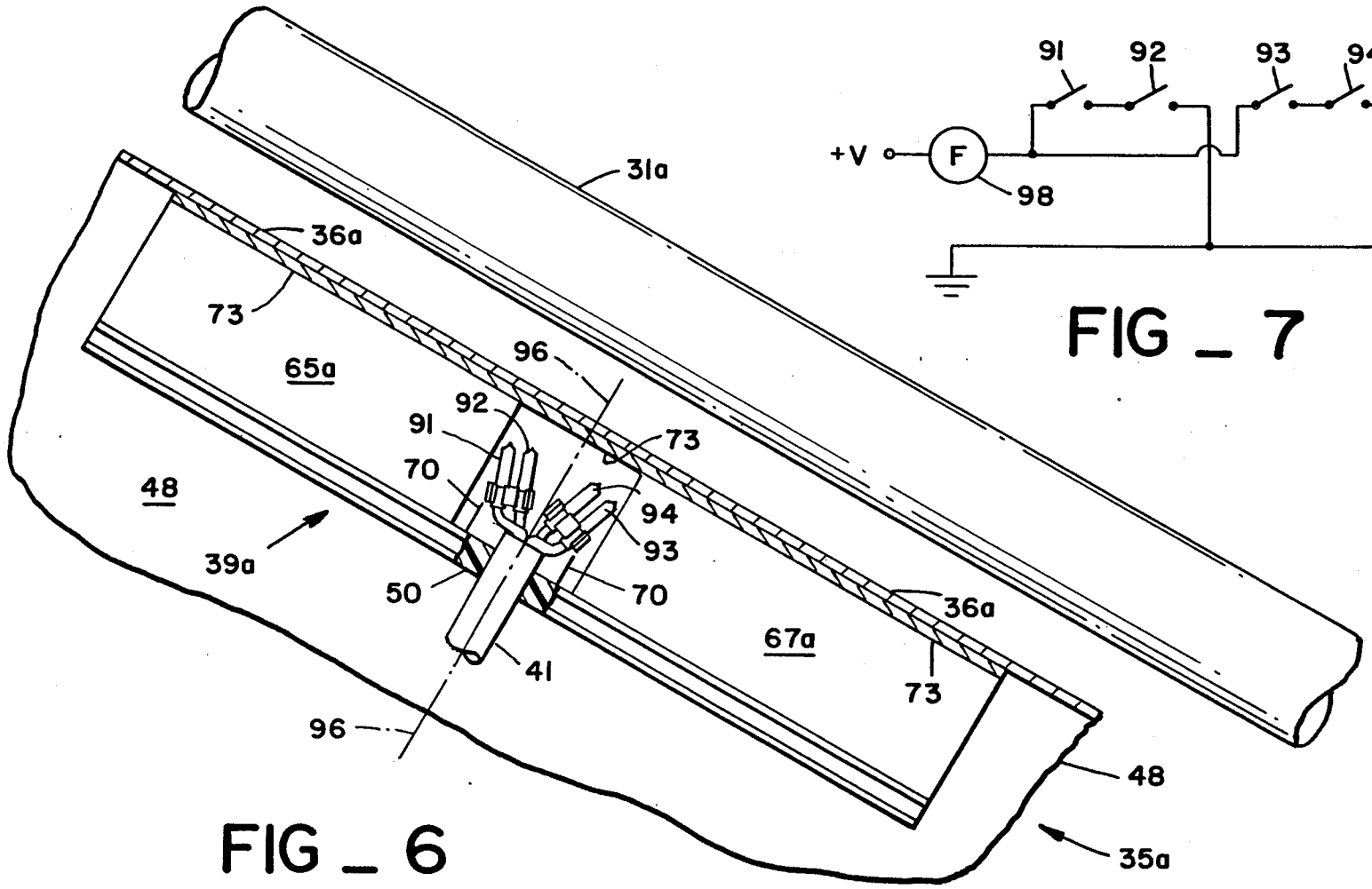
FIG. 6 is a side elevation of an alternative embodiment to the embodiment shown in FIGS. 1-5.
FIG. 7 is a circuit diagram illustrating the electrical connection of the switches in the sensor embodiment of FIG. 6.

In FIG. 7 an alternative embodiment of the deropement sensor apparatus of the present invention is shown. Mounted in housing 35*a* between permanent magnets 65*a* and 67*a* are four mercury switches 91–94. Switches 91 and 92 are skewed at an angle from a plane 96 while switches 93 and 94 are skewed at an angle on an opposite side of plane 96. As will be seen, the entire magnet assembly 39*a* is skewed with respect to a horizontal plane.

As best may be seen in FIG. 7, switches 91 and 92 are electrically connected to each other in series, while switches 93 and 94 also are electrically connected to each other in series. The first set of switches 91 and 92 are further electrically connected to the second set of switches 93 and 94 in parallel.

Since most aerial tramway haul ropes are used to convey personnel up an inclined terrain, housing 35*a* and support wall 36*a* will normally also be inclined so as to parallel haul rope 31*a*. Inclining switches 91–94 with respect to plane 96, which plane would be vertical if the assembly were horizontaly oriented, insures that the mercury in at least one of the two sets of switches is in a position to close the switches notwithstanding inclination of the magnet assembly. Providing two switches in series in each set of switches insures that if either of the switches in a set opens, the power to the haul rope drive is interrupted.

In the preferred form the sets of switches 91–92 and 93–94 are inclined at about 20 degrees with respect to opposite sides of plane 96. This will insure that one set of switches will be closed for a wide rage of slopes, regardless of which end of assembly 39*a* is facing uphill.

Additionally, the embodiment of FIGS. 6 and 7 preferably includes a fuse 98 mounted in series with the sets of switches 91–92 and 93–94. Fuse 98 provides lightning strike protection. While a lightning strike at the sensor tower will probably cause switches 91–94 to become inoperable in an open position, i.e., blow the mercury switches open, the lightning discharge also could vaporize the mercury and/or melt together contacts within the switches. Fuse 98 insures that an open circuit will result at the sensor which will require inspection of the switches to determine whether or not they have been damaged, as well as replacement of fuse 98. This provides a fail-safe system in which the operator cannot operate the haul rope without realizing that the tower has experienced a lightning strike that has incapacitated the deropement sensor apparatus.

The remaining reference numerals in FIG. 6 correspond to elements described above in connection with FIGS. 1–5.

As will be apparent from the above description, the method of detecting lateral displacement of a longitudinally advancing haul rope of the present invention is comprised of the steps of mounting magnet means 39 proximate a side of haul rope 31 at a distance spaced from the haul rope sufficiently small to magnetically couple the haul rope and magnetic means together. The magnetic means is further biased, preferably by gravity, for movement away from haul rope 31 by a biasing force less than the magnetic attraction force. Finally, detection means, such as electrical switch 75 and an associated electrical circuit, is actuated in the event of movement of the haul rope laterally a sufficient distance from magnet means 39 to reduce the attraction force to less than the biasing force so that movement of the magnet means actuates the detection means.

The present apparatus and method has substantial advantages over conventional systems. It is insensitive to snow and ice, is not dependent on fragile and unreliable reed switches, and can detect an impending deropement.

Although the present invention has been described with particular reference to the illustrated preferred embodiments, it is to be understood that such disclosure is not to be interpreted as limiting. Various other alternations, modifications and embodiments will no doubt become apparent to those skilled in the art after having read the preceding disclosure. Accordingly, it is intended that the appended claims be interpreted as covering all such alternations, modifications and embodiments as fall within the true spirit and scope of the present invention.

What is claimed is:

1. A deropement sensor for detecting impending deropement of a wire haul rope from support sheave means, said haul rope being formed from magnetic field responsive material, and said sensor including mounting means including a housing having a top wall member formed for mounting of said sensor proximate a side of said haul rope; magnet means mounted in said housing for movement between an armed position proximate said top wall member and said haul rope and a moved position away from said top wall member; means biasing said magnet means toward said moved position with a biasing force; said mounting means being further formed to position said magnet means in said armed position at a distance sufficientlv close to said haul rope so that a magnetic attraction force between said magnet means and said haul rope is greater than said biasing force to thereby hold said magnet means in said armed position, said distance further being sufficiently far from said haul rope so that movement of said haul rope a predetermined lateral distance away from said magnet means will reduce said attraction force below said biasing force and cause said magnet means to fall away from said top wall member to said moved position; and switch means carried by said sensor and formed for switching to a changed state upon movement of said magnet means from said armed position to said moved position, wherein the improvement in said deropement sensor comprises:

an electrical conductor coupled to said switch means and including a flexible conduit member having sufficient strength to suspend said magnet means within the housing after said magnet means falls away from said top wall member.

2. A deropement sensor for detecting impending deropement of a wire haul rope from support sheave means, said haul rope being formed from magnetic field responsive material, said sensor including mounting means formed for mounting of said sensor proximate a side of said haul rope; magnet means mounted to said mounting means for movement between an armed position proximate said haul rope and a moved position; means biasing said magnet means toward said moved position with a biasing force; said mounting means being further formed to position said magnet means in said armed position at a distance sufficiently close to said haul rope so that a magnetic attraction force between said magnet means and said haul rope is greater than said biasing force to thereby hold said magnet means in said armed position, said distance further being sufficiently far from said haul rope so that movement of said haul rope a predetermined lateral distance away from said magnet means will reduce said attraction force below said biasing force and cause movement of said magnet means to said moved position: and switch means carried by said sensor and formed for switching to a changed state upon movement of said magnet means from said armed position to said moved position, wherein the improvement in said deropement sensor comprises:

said magnet means includes a pair of spaced apart bar magnets and a ferromagnetic support member to which said bar magnets are attached, said bar magnets being positioned such that the south pole of one lies flush against the support member and the north pole of the other lies flush against said support member so that magnetic lines of force run through said support member between said poles to form a horseshoe magnet; and said switch means is carried by said support member at a position between said bar magnets.

3. A deropement sensor for detecting impending deropement of a wire haul rope from support sheave means, said haul rope being formed from magnetic field responsive material, said sensor including mounting means formed for mounting of said sensor proximate a side of said haul rope; magnet means mounted to said mounting means for movement between an armed position proximate said haul rope and a moved position; means biasing said magnet means toward said moved position with a biasing force; said mounting means being further formed to position said magnet means in said armed position at a distance sufficiently close to said haul rope so that a magnetic attraction force between said magnet means and said haul rope is greater than said biasing force to thereby hold said magnet means in said armed position, said distance further being sufficiently far from said haul rope so that movement of said haul rope a predetermined lateral distance away from said magnet means will reduce said attraction force below said biasing force and cause movement of said magnet means to said moved position; and position-responsive switch means carried by said sensor and formed for switching to a changed state upon movement of said magnet means from said armed position to said moved position, wherein the improvement in said deropement sensor comprises:

said position-responsive switch means includes a first pair and a second pair of position-responsive switches, and wherein the two switches of said first pair are electrically connected in series and the two switches in the second pair are electrically connected in series and said first pair and said second pair are electrically connected in parallel and positioned skewed in orientation relative to oposite sides of a plane transverse to said wire haul rope such that, when the magnet means is positioned in said armed position, current will flow through at least one of the switches of said first pair or said second pair even upon skewing of said mounting means to an orientation substatially parallel to an inclined wire haul rope.

4. A system according to claim 3 wherein, said two switches of said first pair are skewed at about twenty degrees on one side of said plane, and said two switches of said second pair are skewed at about twenty degrees on the other side of said plane.

* * * * *